US006160524A

United States Patent [19]

Wilber

[11] Patent Number: 6,160,524

[45] Date of Patent: Dec. 12, 2000

[54] APPARATUS AND METHOD FOR REDUCING THE TEMPERATURE SENSITIVITY OF FERROELECTRIC MICROWAVE DEVICES

[75] Inventor: William D. Wilber, Neptune, N.J.

[73] Assignee: The United States of America as represented by the Secretary of the Army, Washington, D.C.

[21] Appl. No.: 09/270,699

[22] Filed: Mar. 17, 1999

[51] Int. Cl.[7] ..... H01Q 1/00

[52] U.S. Cl. ..... 343/787; 343/778; 343/700 MS

[58] Field of Search ..... 343/700 MS, 787, 343/778; H01Q 1/38, 1/00

[56] References Cited

U.S. PATENT DOCUMENTS 5,557,286 9/1996 Varadan et al. ..... 343/700 MS 5,731,220 3/1998 Tsu et al. ..... 437/60

*Primary Examiner*—Don Wong

*Assistant Examiner*—Hoang Nguyen

*Attorney, Agent, or Firm*—Michael Zelenka; George B. Tereschuk

[57] ABSTRACT

To control the temperature sensitivity of a ferroelectric microwave device, a microwave waveguide in the device is loaded with a modified ferroelectric material of reduced grain size less than 100 nm, preferably about 50 nm. The electrical properties of this material are less sensitive to temperature change. Thus, when a dc bias voltage is applied across the ferroelectric to tune the dielectric constant, changes in temperature will have a minimal effect on the desired tuning of the device.

12 Claims, 1 Drawing Sheet

APPARATUS AND METHOD FOR REDUCING THE TEMPERATURE SENSITIVITY OF FERROELECTRIC MICROWAVE DEVICES

GOVERNMENT INTEREST

The invention described herein may be manufactured, used, and licensed by or for the Government for governmental purposes without the payment to me of any royalty thereon.

FIELD OF INVENTION

This invention relates to microwave devices and, more particularly, to a method which uses ferroelectric material in a microwave device to control the temperature sensitivity of that ferroelectric microwave device.

BACKGROUND OF INVENTION

Ferroelectric materials are used in microwave devices to control the propagation of a microwave signal. This use in microwave phase shifters and quasi-optical antenna arrays is described in Varadan et al. (Microwave Journal 34, 116 (1992)), Babbitt et al. (Microwave Journal 35, 63 (1992)), and Vendik & Ter-Martirosyan (Microwaves & RF, July, 67 (1994)).

In a ferroelectric phase shifter, for example, the microwave signal is loaded with ferroelectric material in a way such that the microwave signal must interact with (or travel through) the ferroelectric. The geometry must also allow for the application of a dc bias voltage across the ferroelectric material.

A typical ferroelectric material for this use is barium strontium titanate (hereinafter referred to as BST). It is known that when a dc electric field is applied to BST, the dielectric constant of the BST decreases with increasing field strength.

Thus, in a ferroelectric phase shifter, when a dc electric field is applied across the ferroelectric material, i.e. BST, the change in dielectric constant changes the effective electrical path length of the waveguide and therefore, the output signal changes phase relative to the zero dc bias condition. Thus, the change in dielectric constant due to an applied dc electric field is the fundamental basis of operation for any ferroelectric microwave device.

The operating characteristics of current ferroelectric microwave devices, such as phase shifters, are strongly affected by temperature because the electrical properties of the ferroelectric material change rapidly with temperature. In particular, it is known that for many ferroelectric materials, and for BST in particular, the large grain size of the material influences the electrical properties.

The prior art reveals an important problem associated with the current generation of ferroelectric devices. A small change in temperature of the device will result in a change in the dielectric constant even without an electric bias. Any device using this type of material will be, therefore, highly temperature sensitive.

It is an object of the present invention to provide a method which eliminates or greatly reduces the temperature sensitivity of ferroelectric material in a ferroelectric microwave device.

SUMMARY OF THE INVENTION

The present invention uses a structurally modified ferroelectric material, which has a reduced grain size, as the active component of a ferroelectric microwave device. The electrical properties of this ferroelectric material are relatively insensitive to temperature (Lee et al., J. Appl. Phys. 80 (10), 5891 (1996); Korikawa et al., J. Appl. Phys. 32, 4126 (1993); Tahan, Ph.D. thesis, Rutgers University, to be published, (1997); Jaffe et al., Piezoelectric Ceramics (Academic Press, India 1971), 86-67). In order to satisfy the object of the invention, the ferroelectric materials grain size is reduced, below a certain level, thereby obviating temperature dependant performance of the device. This effect tends to flatten the curve of a dielectric constant vs. temperature and simultaneously lowers the curie temperature (Horikawa et al., J. Appl. Phys. 32, 4126 (1993)). It is especially striking for grains smaller than 100 nm in diameter, and grain sizes of approximately 50 nm may be necessary to minimize the temperature dependence for practical applications. Horikawa et al. (J. Appl. Phys. 32, 4126 (1993)) show that the slope of the curve and the magnitude of the dielectric constant for these small grained materials can be tailored by changing the Ba/Sr ratio, and one can achieve materials that show essentially flat dielectric constant vs. temperature curves for temperature variations as great as 100° C.

While these devices are known as ferroelectric microwave devices, the term 'ferroelectric' may be a misnomer. The devices used are actually operating at temperatures several degrees above the Curie temperature of the material, causing it to be in a paraelectric phase. However, as used herein, the term ferroelectric is intended to describe such materials in their ferroelectric and/or paraelectric phases.

The temperature used is slightly above the Curie temperature of the material for two reasons. The first is that material in a ferroelectric phase preferably is not used because in this phase there will be an inherent hysteresis making the device nonlinear with respect to the dc bias and the microwave power loss will also increase. Thus, in order to prevent having the material in a ferroelectric phase, temperatures lower than the Curie temperature must be avoided. The second reason is that the dielectric constant will drop at temperatures lower than the Curie temperature to reduce tunability, which is the ratio of change in dielectric constant divided by the initial, unbiased dielectric constant.

BRIEF DESCRIPTION OF THE DRAWINGS

These and other objects, features, and details of the invention will become apparent in light of the ensuing detailed disclosure, and particularly in light of the drawings wherein.

DETAILED DESCRIPTION OF THE DRAWINGS

Figure 1:
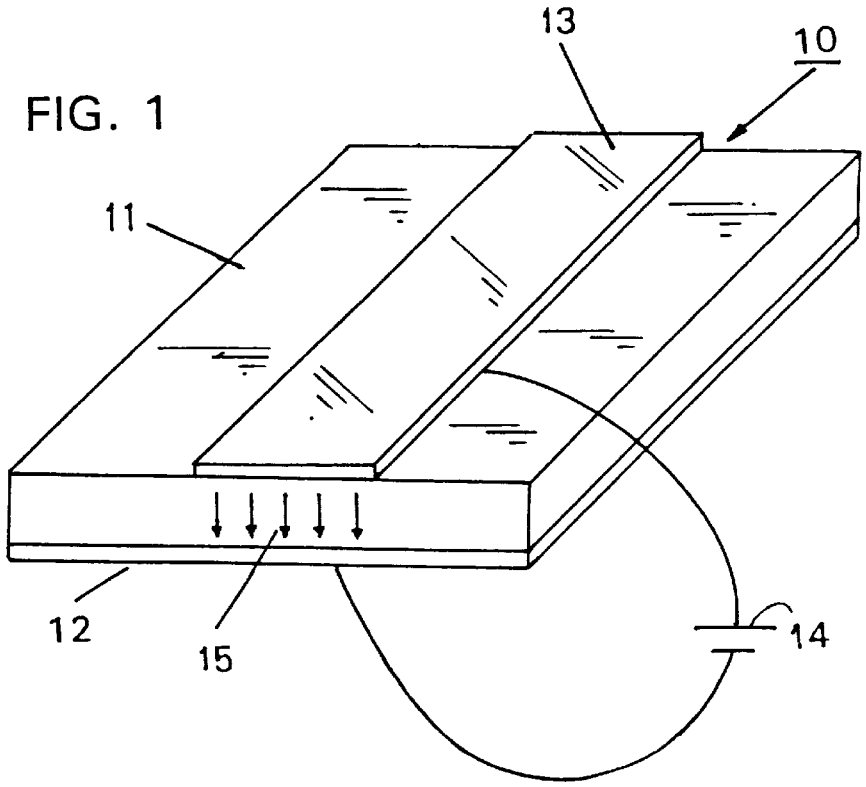
FIG. 1 shows a generic ferroelectric microwave device using a microstrip waveguide.

With reference to FIG. 1, a generic ferroelectric microwave device 10 is formed by placing a ferroelectric material 11 in between a single ground plane 12 and a microstrip waveguide 13, which is used as a transmission line. The ferroelectric microwave device 10 is loaded with ferroelectric material 11 in such a way that the microwave signal must interact with (or travel through) the ferroelectric material 11. A dc bias voltage 14 is applied across the ferroelectric material 11 and creates the dc electric field 15 across the ferroelectric material 11. The dielectric constant of the ferroelectric material 11 will change in response to the magnitude of the electric field 15, which causes the effective electrical path length of the waveguide to change so that the output signal changes phase relative to the zero dc bias condition.

In accordance with the present invention, the temperature sensitivity of the ferroelectric microwave device is controlled by loading the microwave waveguide of the device with a modified ferroelectric material of reduced grain size less than 100 nm, preferably about 50 nm. The electrical properties of this material are less sensitive to temperature change. Thus, when a dc bias voltage is applied across the ferroelectric material and a microwave signal is sent through the waveguide, the dielectric constant remains relatively unchanged. This material is preferably at a temperature slightly above its Curie temperature.

Figure 2:
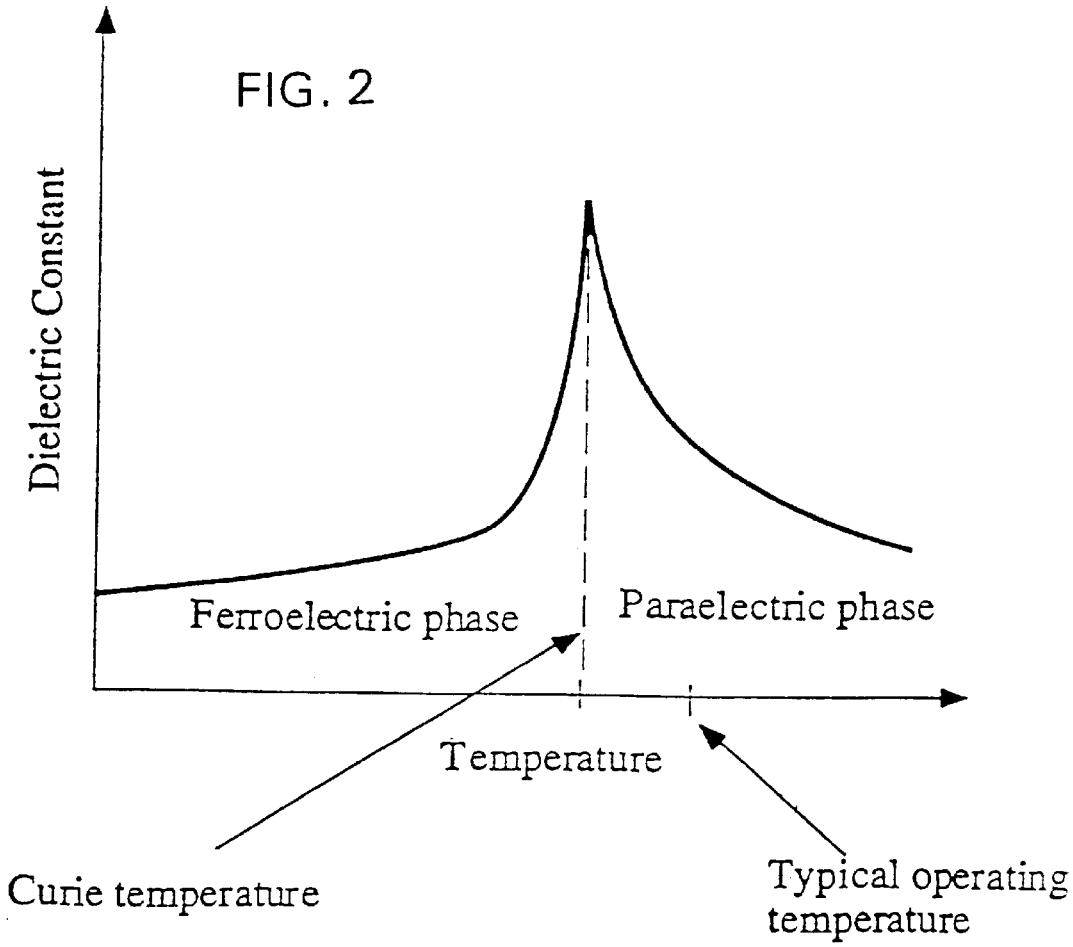
FIG. 2 depicts a graph of the dielectric constant as a function of temperature for a generic ferroelectric material.

FIG. 2 depicts a graph of the dielectric constant as a function of temperature for a generic ferroelectric material. As can be seen, the temperature chosen for operation is several degrees above the Curie temperature of the material.

From this graph, one can see that a small change in the temperature of the device will result in a change in the dielectric constant even without an electric bias. Any device using this type of a generic ferroelectric material will be, therefore, highly temperature sensitive.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ferroelectric microwave device with reduced temperature sensitivity, comprising:

a ferroelectric body is placed between a waveguide structure means and a ground plane;

said ferroelectric body, being loaded with a ferroelectric material composed of a plurality of ferroelectric grains, is connected to a high frequency transmission line of said waveguide structure;

a dc bias voltage means applies a dc voltage across said ferroelectric material to provide a dc electric field across said ferroelectric material;

a propagating electromagnetic energy is generated by dc electric field;

said ferroelectric body having a given dielectric constant in the presence of a zero bias electric field secured to said waveguide structure whereby at least a portion of said propagating electromagnetic field is propagated through said ferroelectric body;

a means for producing a dc bias field through said ferroelectric body for modifying the dielectric constant thereof in a predetermined manner; and said ferroelectric body having a grain size which is less than about 100 nm.

2. The microwave device of claim 1, in which said wave guide structure is a microstrip waveguide.

3. The microwave device of claim 2, in which said ferroelectric body has a grain size which is about 50 nm.

4. The microwave device of claim 1, in which said ferroelectric body is barium strontium titanate.

5. The microwave device of claim 4, in which said ferroelectric body has a grain size which is about 50 nm.

6. The microwave device of claim 1, in which said ferroelectric body has a grain size which is about 50 nm.

7. The microwave device of claim 1, in which said ferroelectric body is heated to slightly above its Curie temperature.

8. The microwave device of claim 7, in which said ferroelectric body has a grain size which is about 50 nm.

9. A method of reducing sensitivity of a ferroelectric microwave device, the steps of:

loading a ferroelectric body with a ferroelectric material composed of a plurality of ferroelectric grains, each of said plurality of grains having a grain size of less than 100 nm;

forming said ferroelectric body to a given shape;

placing said ferroelectric body between a waveguide structure means and a ground plane;

connecting said ferroelectric material to a high frequency transmission line of said waveguide structure;

securing said ferroelectric body to an interior surface of said high frequency transmission line which guides the transmission therethrough of a propagating electromagnetic energy;

said ferroelectric body providing a given dielectric constant in the presence of a zero bias electric field secured to said waveguide structure whereby at least a portion of said propagating electromagnetic field is propagated through said ferroelectric body; applying an electric field bias means to said ferroelectric body in such a way that the variation of an electric field from said bias means will vary the dielectric constant of said ferroelectric body in a predetermined manner, whereby an energy propagating field through said transmission line is controlled in a predetermined manner and is relatively insensitive to temperature variations.

10. The method of manufacture of a microwave device of claim 9, in which said wave guide structure is a microstrip waveguide.

11. The method of manufacture of a microwave device of claim 9, in which said ferroelectric body has a grain size which is about 50 nm.

12. The method of manufacture of a microwave device of claim 9, in which said ferroelectric body is adapted to be heated to slightly above its Curie temperature.

* * * * *